4/9/85 XR 4,509,350

United States Patent [19]

Gartner

[11] Patent Number: 4,509,350

[45] Date of Patent: Apr. 9, 1985

[54] PROTECTIVE LOCK MOUNTING PLATE FOR SAFE DOOR LOCKS

[76] Inventor: Klaus W. Gartner, 2632 Via Anacapa, Palos Verdes Estates, Calif. 90274

[21] Appl. No.: 508,119

[22] Filed: Jun. 27, 1983

[51] Int. Cl.[3] ..... E05B 15/16

[52] U.S. Cl. ..... 70/333 R; 109/84; 70/417; 70/DIG. 43

[58] Field of Search ..... 70/333 R, 416, 417, 70/1.5, 333 A, DIG. 43, DIG. 56; 109/49.5, 82–84

[56] References Cited

U.S. PATENT DOCUMENTS

| | | | |
|---|---|---|---|
| 261,533 | 7/1882 | Corliss | 109/83 |
| 881,032 | 3/1908 | Schultz | 70/417 |
| 1,607,426 | 11/1926 | Bell et al. | 70/417 X |
| 3,844,019 | 10/1974 | Shwayder et al. | 70/417 X |
| 3,976,434 | 8/1976 | Shwayder | 70/417 X |
| 4,142,388 | 3/1979 | Phillips . | |

FOREIGN PATENT DOCUMENTS

| | | | |
|---|---|---|---|
| 2557151 | 7/1976 | Fed. Rep. of Germany | 70/417 |
| 828293 | 2/1960 | United Kingdom | 70/416 |
| 883005 | 11/1961 | United Kingdom | 70/417 |

*Primary Examiner*—Gary L. Smith
*Assistant Examiner*—Thomas J. Dubnicka
*Attorney, Agent, or Firm*—Poms, Smith, Lande & Rose

[57] ABSTRACT

A protective lock mounting plate is provided between a lock housing on the interior of a safe door and the interior surface of the safe door to resist drilling into the lock housing through the door in areas adjacent a combination dial, or the like, on the exterior of the safe door in a frontal location relative lock works within the lock housing. Non-drillable material is positioned in annular rings bonded in grooves of concentric circular configuration formed in a surface of the mounting plate which is directed against the interior surface of the door facing in the direction from which drilling intrusion is anticipated.

3 Claims, 3 Drawing Figures

PROTECTIVE LOCK MOUNTING PLATE FOR SAFE DOOR LOCKS

BACKGROUND OF THE INVENTION

The present invention relates in general to combination and key operated locks of safes and more specifically to a protective lock mounting plate for mounting a lock, and its associated lock works, interiorly of the safe door in a manner to resist and impede drilling through the door in areas of the door which front the interiorly mounted door lock works.

It is common to provide combination locks in safe doors in the manner illustrated in prior U.S. Pat. No. 4,142,388. In such arrangements, the lock works, contained within a lock housing, are mounted to a interior surface of the safe door with a lock dial and manually operated knob positioned exteriorly of the door. Persons wishing to gain unauthorized entry into the safe recognize that the lock works are generally located behind the lock dial and attempt to defeat the lock by drilling holes through the dial, safe door, lock housing and lock works. Then through the use of probes, picks and the like, the lock can perhaps be manipulated to cause release of the associated latch from the safe wall or keeper which receives the latch.

It is therefore the primary object of the present invention to disclose and provide a protective means for preventing and impeding the unauthorized intrusion into the lock as by drilling through the safe door. It is also an object of the present invention to provide a means for easily mounting the lock housing and associated lock works to the interior of the safe door in association with the protective means stated such that normal, authorized manipulation of the lock is not in anyway impeded.

SUMMARY OF THE INVENTION

Generally stated, the present invention in protective means for an interiorly mounted lock of a safe door comprises the provision of a plate-like body of hardened material on the interior of the safe door, the body having a throughbore to receive the shaft of the dial which extends through the door for manipulating the internal lock works via the external dial, means for mounting the body to the inner surface of the safe door with the body throughbore aligned to the dial shaft receiving bore through the door and means for mounting the lock housing in turn to the body with the dial shaft of the lock extending through the lock housing, body throughbore and door bore whereby the lock words are protected against intrusion as by unauthorized drilling attempted through the door in areas frontal of the lock housing.

More specifically, the protective means, comprising a plate-like body, is provided with a non-drillable material therein which, in the preferred embodiment, comprises the provision of a plurality of concentric rings of non-drillable material, such as ceramic chips, carbide chips, or the like, bonded or otherwise secured and maintained in a plurality of mating grooves formed in a surface of the protective body which faces the inner surface of the safe door.

It is submitted that a better understanding of the present invention in a protective lock mounting plate for mounting a lock to the interior of a safe door, will be afforded to those skilled art, from a consideration of the following detailed description of a preferred exemplary embodiment, during which reference will be made to the appended sheet of drawings which will first be briefly described.

DESCRIPTION OF A PREFERRED EXEMPLARY EMBODIMENT

Figure 1:
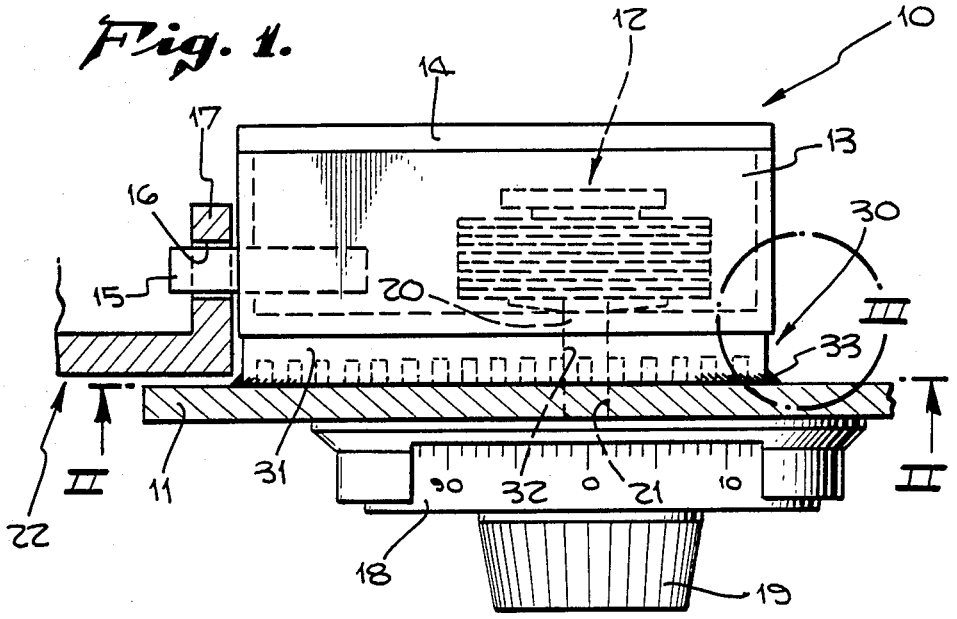
FIG. 1 is a plan view of an exemplary embodiment of combination lock mounted to a safe door with which an exemplary embodiment of protective lock mounting plate, in accordance with the present invention, is illustrated.

Referring now to FIG. 1, an exemplary embodiment of combination lock is indicated generally at 10 on the interior of an exemplary safe door 11. Lock works, are indicated generally at 12 in phantom lines as being within lock housing 13 which is of box configuration having a removable rear wall 14. The combination lock illustrated generally at 10, may be constructed as more fully explained in U.S. Pat. No. 4,142,388 and includes a latch or bolt 15 adapted for retractable insertion into opening 16 of safe wall 17. The lock may further have, exteriorly of door 11, a combination dial 18 manipulated by knob 19, the latter two being mounted to dial shaft 20. Shaft 20 extends through a throughbore 21 in the safe door as well as a bore in lock housing 13 so that the lock works, indicated generally at 12, mounted within lock housing 13 on the interior of door 11 may be manipulated by an operator turning the knob 19 exteriorly of the door.

As discussed hereinbefore, it is has been found that persons attempting an unauthorized entry into the safe, indicated generally at 22 may attempt to drill into the lock works in order to manipulate it via dial 19 or probes inserted through drilled openings through the door to withdraw latch 15 from the safe wall opening 16. As particularly contemplated within the present invention, a protective lock mounting plate, indicated generally at 30, is interposed between the lock, indicated generally at 10, and the safe door 11 in a position to resist anticipated efforts to drill through the door in the areas of the lock dial which generally lie forwardly of the lock works.

Figure 2:
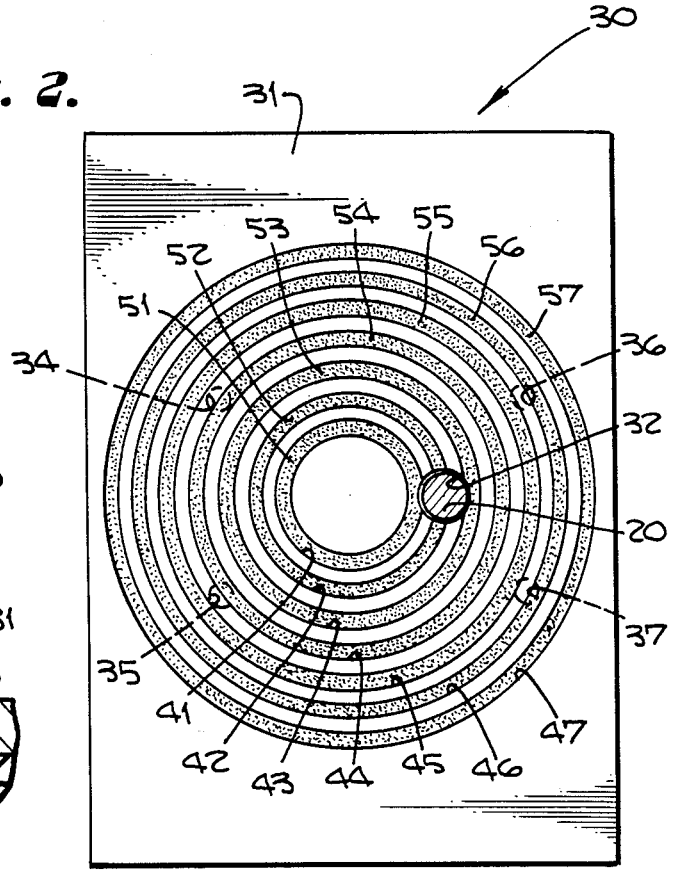
FIG. 2 is an elevational view of the front face of the protective lock mounting plate of FIG. 1, with a portion of the exemplary lock in section, taken in the plane II—II in FIG. 1.
Figure 3:
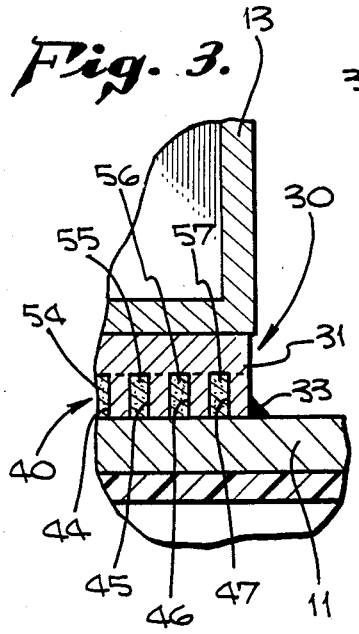
FIG. 3 is a detail section view of portions of the exemplary protective lock mounting plate and an exemplary lock of FIG. 1.

The protective lock mounting plate, indicated generally at 30, of the present invention in the exemplary embodiment comprises a platelike body 31 of a hardened material and having a body throughbore 32 to receive the dial shaft 20 therethrough, as best seen in FIG. 2. Bore 32 may be located anywhere in plate 31 in order to facilitate alignment with dial shaft 20. When the plate is assembled to the door in position to mount and protect the associated lock. As seen in FIG. 2, bore 32 is offset from the center of the plate-like body 31.

Means are provided for mounting the plate-like body 31 to the surface of the safe door with the plate throughbore 32 aligned to the shaft receiving bore 21 of safe door 11. In the exemplary embodiment, such means include the provision of welds 33, as seen in FIG. 1, suitably made about the periphery of body 31 to securely mount it to the rear, or interior surface of the safe door 11.

As is also contemplated within the present invention, means are provided for mounting the lock housing 13 to the protective body 31 with the dial shaft 20 passing through the housing bore of the lock as well as the bores of the door and body, 21 and 32 respectively, described before. In the exemplary embodiment, and as best seen in FIG. 2, a plurality of mounting holes 34, 35, 36 and 37 are drilled in the rear surface of body 31 and are tapped to receive mounting bolts therein. The forward wall of housing 13 may be suitably drilled to allow mounting bolts to pass therethrough and seat in mounting holes 34, 35, 36 and 37 to mount the lock housing 13 to the rear surface of protective body 31.

As particularly contemplated within the present invention, the lock intrusion resistance of the protective plate-like body 31 is enhanced through the provision of the addition of non-drillable material. Specifically, a non-drillable material, such as chips of hard material such as carbide or ceramic chips, may be added as discrete parts by being embedded in the body. In the exemplary embodiment, the addition of such discrete parts or chips is accomplished through the provision of a plurality of concentric grooves indicated generally at 40, and comprising the array of outwardly, enlarging set of seven circular grooves, 41–47 as seen in FIG. 2. These grooves are filled with a non-drillable material, which in the exemplary embodiment, includes the provision of carbide or ceramic chips bonded, as by braising, or the like, into the grooves to form an array of outwardly expanding, concentric drilling resistant rings 51 through 57.

It is submitted that those skilled in the art will recognize from the foregoing description of a preferred exemplary embodiment of the present invention in a protective lock mounting plate for mounting a lock to the interior of a safe door, that the foregoing advantages and objects have been attained by the present invention. The drilling of a lock, interiorly of the safe door, by drilling through the door adjacent to the dial of a combination lock, or the keyhole of a key combination lock, or the like, is prevented, or at least greatly hindered, through the provision of the protective mounting plate indicated generally at 30. As described herein, the mounting plate may be hardened, as by carburizing or other known metal hardening processes and its resistance to drilling can be enhanced through the addition of discrete particles or chips of a non-drillable material in a random manner, or preferably, in the circular, concentric ring like pattern of the present embodiment in order to facilitate the manufacturing thereof. The plate is mounted with the grooves and non-drillable material rings 41–47 and 51–57, respectively, facing the inner surface of the safe door, facing in the direction from which unauthorized drilling intrusion is anticipated. The spacing of the grooves and rings formed therein is preferably such as to prevent the successful drilling therebetween of a hole of size sufficient to accommodiate the size of probe or pick required for attempting to manipulate the lock works within the door in a manner to cause release of the lock and opening of the door.

Having thus described a preferred exemplary embodiment of protective lock mounting plate for mounting a lock to the interior of safe door in a drilling resistant mode, it should be understood by those skilled in the art that the within disclosure is exemplary only and that various modifications, adaptations and alternate embodiments thereof may be made within the scope of the present invention which is defined by the following claims.

I claim:

1. A protective lock mounting plate for mounting a lock to the interior of a safe door, said lock having a lock housing containing lock works mounted interiorally of the safe door, a dial shaft associated with said works for operating the same and a lock dial mounted to an outer end of the dial shaft exteriorally of the safe door, said safe door having a shaft receiving bore to facilitate passage of said shaft therethrough, said protective lock mounting plate comprising:

a plate-like body of hardened material having a body throughbore to receive said dial shaft of said safe door lock therethrough wherein said plate-like body is provided with a plurality of concentric circular grooves and a material of greater hardness than the plate-like body is positioned in at least one of said grooves;

means for mounting said body to the inner surface of said safe door with said body throughbore aligned to said shaft receiving bore of said door; and means for mounting said lock housing to said body with said dial shaft extending through said body throughbore and door bore whereby said lock works are protected against intrusion as by drilling through said door.

2. The protective lock mounting plate of claim 1 wherein:

said body is mounted to said safe door with said grooves facing said door inner surface.

3. The protective lock mounting plate of claims 1 or 2, wherein:

said non-drillable material comprises chips of hard materal, such as carbide or ceramic chips, bonded in said grooves.

* * * * *